US008093970B2

(12) United States Patent
Li

(10) Patent No.: US 8,093,970 B2
(45) Date of Patent: Jan. 10, 2012

(54) BRAIDED ELECTRICAL CONTACT ELEMENT BASED RELAY

(75) Inventor: Che-Yu Li, Ithaca, NY (US)

(73) Assignee: Montara Technologies LLC, Port Washington, NY (US)

( * ) Notice: Subject to any disclaimer, the term of this patent is extended or adjusted under 35 U.S.C. 154(b) by 275 days.

(21) Appl. No.: 12/249,535

(22) Filed: Oct. 10, 2008

(65) Prior Publication Data

US 2009/0096560 A1 Apr. 16, 2009

Related U.S. Application Data

(60) Provisional application No. 60/979,518, filed on Oct. 12, 2007.

(51) Int. Cl.
*H01H 51/22* (2006.01)

(52) U.S. Cl. ..... 335/78; 335/127; 335/133

(58) Field of Classification Search ..... 335/78, 335/127, 131–135
See application file for complete search history.

(56) References Cited

U.S. PATENT DOCUMENTS

| | | | | |
|---|---|---|---|---|
| 803,486 | A | 10/1905 | Hill | |
| 2,569,776 | A | 10/1951 | Persons | |
| 3,194,920 | A | 7/1965 | Scheib | |
| 4,041,426 | A | 8/1977 | Zemanek et al. | |
| 4,509,027 | A | 4/1985 | Otto et al. | |
| 5,003,274 | A * | 3/1991 | Chikira et al. | 335/83 |
| 5,394,128 | A | 2/1995 | Perreira et al. | |
| 5,427,535 | A * | 6/1995 | Sinclair | 439/66 |
| 5,844,457 | A | 12/1998 | Eckroth et al. | |
| 5,994,986 | A * | 11/1999 | Takahashi | 335/78 |
| 6,075,429 | A * | 6/2000 | Uotome et al. | 335/78 |
| 7,014,479 | B2 * | 3/2006 | Li | 439/86 |
| 7,029,288 | B2 | 4/2006 | Li | |
| 7,029,289 | B2 | 4/2006 | Li | |
| 7,040,902 | B2 | 5/2006 | Li | |
| 7,145,422 | B2 | 12/2006 | Imanishi et al. | |
| 7,358,603 | B2 | 4/2008 | Li | |
| 2004/0212467 | A1 * | 10/2004 | Schwenkedel et al. | 335/128 |
| 2005/0168308 | A1 * | 8/2005 | Ward | 335/229 |
| 2006/0094269 | A1 | 5/2006 | Li | |
| 2006/0211276 | A1 * | 9/2006 | Li | 439/66 |
| 2006/0250201 | A1 * | 11/2006 | Hashimoto et al. | 335/78 |
| 2008/0122562 | A1 * | 5/2008 | Bush et al. | 335/153 |
| 2009/0237191 | A1 * | 9/2009 | Yano et al. | 335/202 |

* cited by examiner

*Primary Examiner* — Bernard Rojas
(74) *Attorney, Agent, or Firm* — Brown & Michaels, PC

(57) ABSTRACT

A relay including a coil or solenoid, at least one fixed substrate and a moving substrate, a plurality of braided electrical contact element contacts making contact with pads on the fixed and moving substrates, returning springs mounted on alignment pins, and an optional cover for hermetical sealing. A further embodiment presents a horizontally-moving armature actuated by one or more solenoids.

21 Claims, 6 Drawing Sheets

BRAIDED ELECTRICAL CONTACT ELEMENT BASED RELAY

REFERENCE TO RELATED APPLICATIONS

This application claims one or more inventions which were disclosed in Provisional Application No. 60/979,518, filed Oct. 12, 20007, entitled "BRAIDED ELECTRICAL CONTACT ELEMENT BASED RELAY". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of electrical relays. More particularly, the invention pertains to miniaturized parallel contact relays using linearly moving armatures.

2. Description of Related Art

The electrical contact used in a large number of currently available relays and switches produces high contact resistance. In order to facilitate high current capabilities a large contact force is usually applied, therefore a robust solenoid is required. There is a need to improve the electrical contact to allow a reduction of the size of the relay or switch while maintaining the high current capabilities.

The limit of size reduction is to fabricate the relays and switches by using MEMS processes. Presently available relays and switches at the MEMS size scale can only handle signal switching. Low contact resistance is beneficial also for the interest of minimizing heat generation. Otherwise a suitable heat sink is required which makes the size of the system larger.

Examples of previously patented electrical relays which used linear-moving armatures include U.S. Pat. No. 803,486 "Magnetically Operated Switch", U.S. Pat. No. 2,569,776 "Electric Switch", U.S. Pat. No. 3,194,920 "Electrical Contactor", U.S. Pat. No. 4,041,426 "Miniature armature relay", U.S. Pat. No. 4,509,027 "Current operated miniature relay", U.S. Pat. No. 5,394,128 "DC vacuum relay device", U.S. Pat. No. 5,844,457 "Electromagnetically operated electric switching apparatus" and U.S. Pat. No. 7,145,422 "DC relay". Reed relays, which comprise small, light contacts sealed in glass tubes, acted upon directly by electromagnets, have been used in the past for high-speed switching, but such relays are limited in their current handling abilities.

The present inventor has a number of issued patents and a published patent application on electrical contacts and connectors which use, among other things, braided contacts as might be used in the present invention. These patents, incorporated herein by reference, include:

U.S. Pat. No. 7,014,479, "Electrical Contact and Connector and Method of Manufacture"

U.S. Pat. No. 7,029,288, "Electrical Contact and Connector and Method of Manufacture"

U.S. Pat. No. 7,029,289, "Interconnection Device and System"

U.S. Pat. No. 7,040,902, "Electrical Contact"

U.S. Pat. No. 7,358,603, "High Density Electronic Packages"

US Published Patent Application 2006/094,269 "Electrical Contact and Connector and Method of Manufacture"

DETAILED DESCRIPTION OF THE INVENTION

The braided electrical contact element of the present inventor, which is described and claimed in previously filed utility patents and applications listed above (incorporated by reference herein), provides negligible contact resistance, low bulk resistance, high elastic compliance, and small size and requires low contact force. Such benefits allow the design of micro-sized relays and switches based on which the patent application is made.

The design concept is illustrated by the attached figures. The components of the first and second illustrated embodiments of the relay include a coil or solenoid, fixed and moving substrates, a plurality of braided electrical contact element contacts, bias element such as returning springs mounted on alignment pins, and an optional cover for protection. A further embodiment presents a horizontally-moving armature actuated by one or more solenoids.

Figure 7:
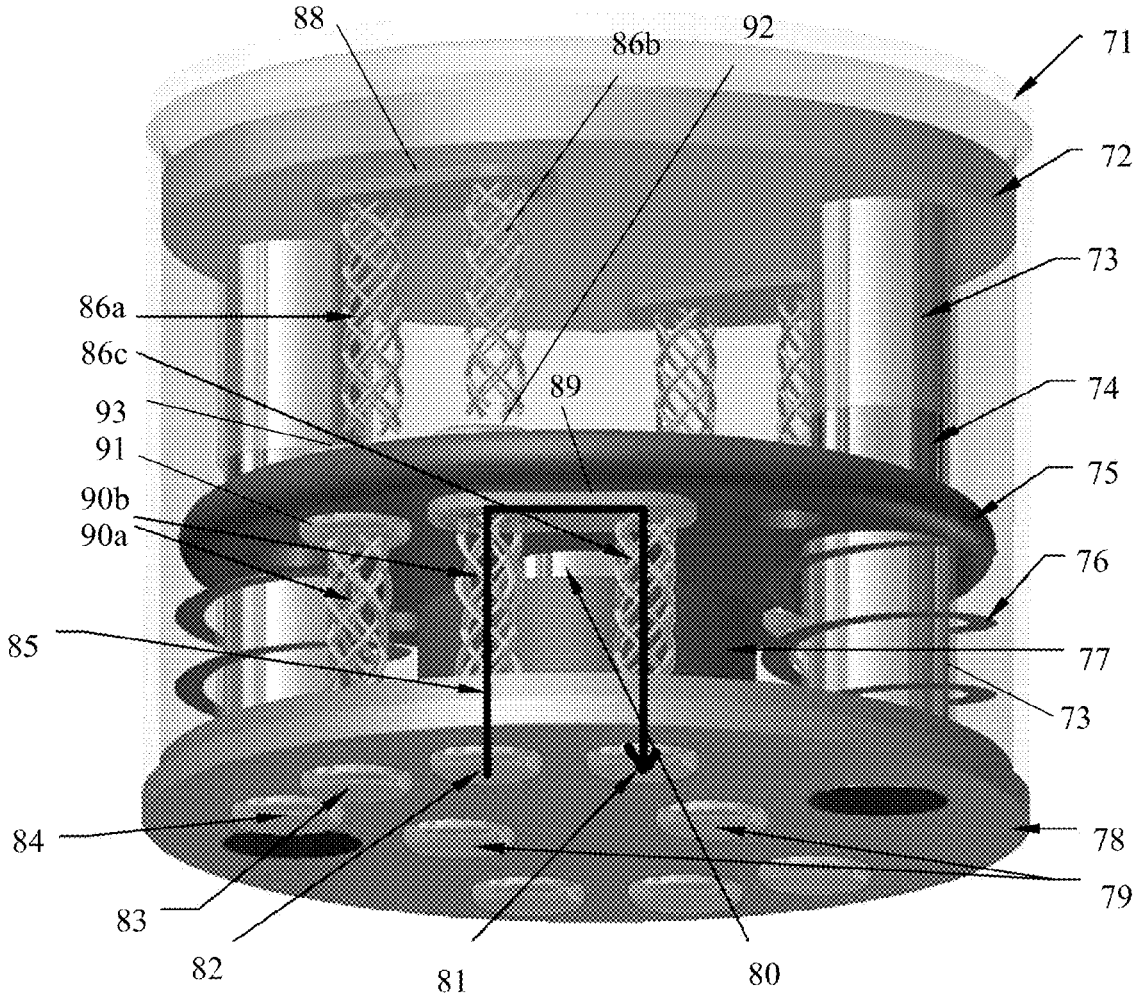
FIG. 7 shows a side view of a double-pole double-throw (DPDT) embodiment of the invention, in a de-energized state.
Figure 8:
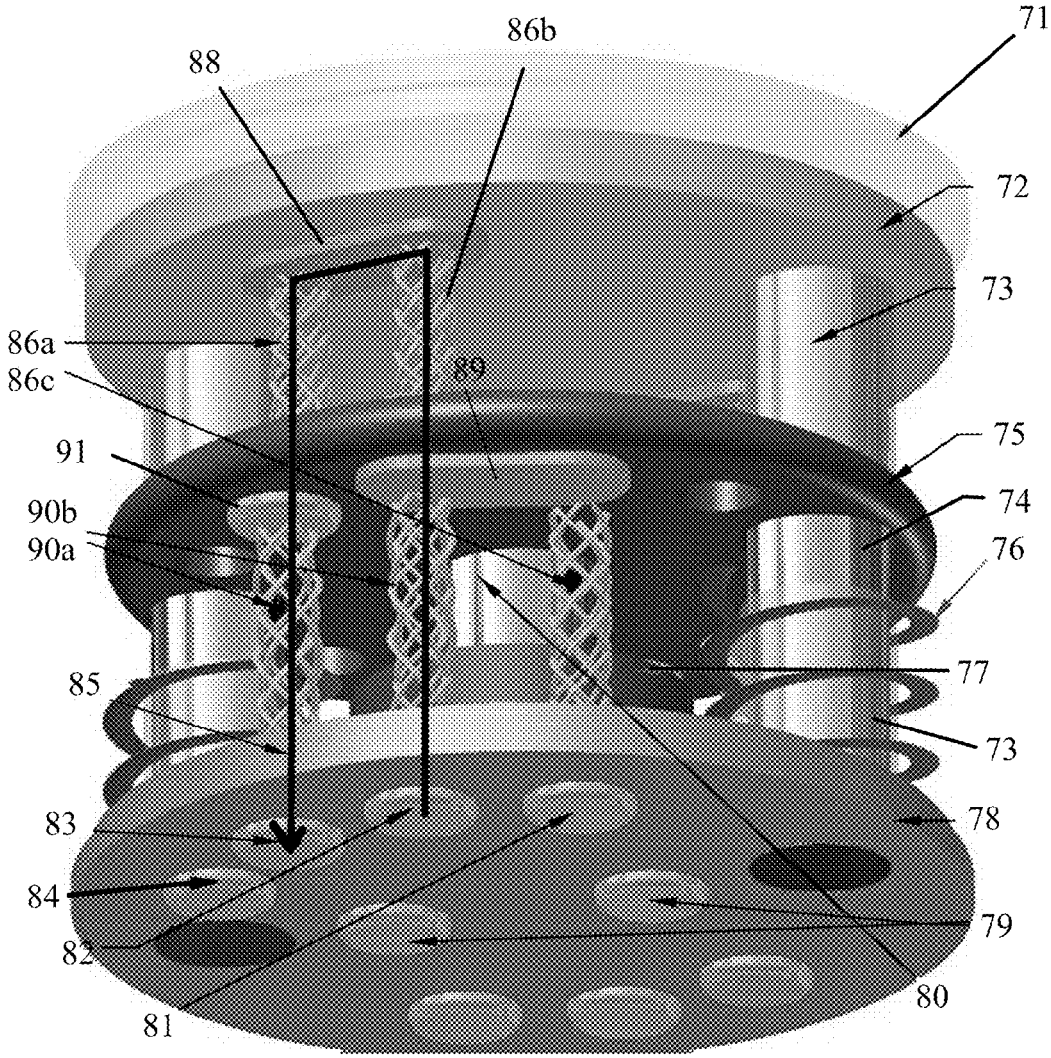
FIG. 8 shows the view of FIG. 7, with the relay in an energized state.
Figure 9:
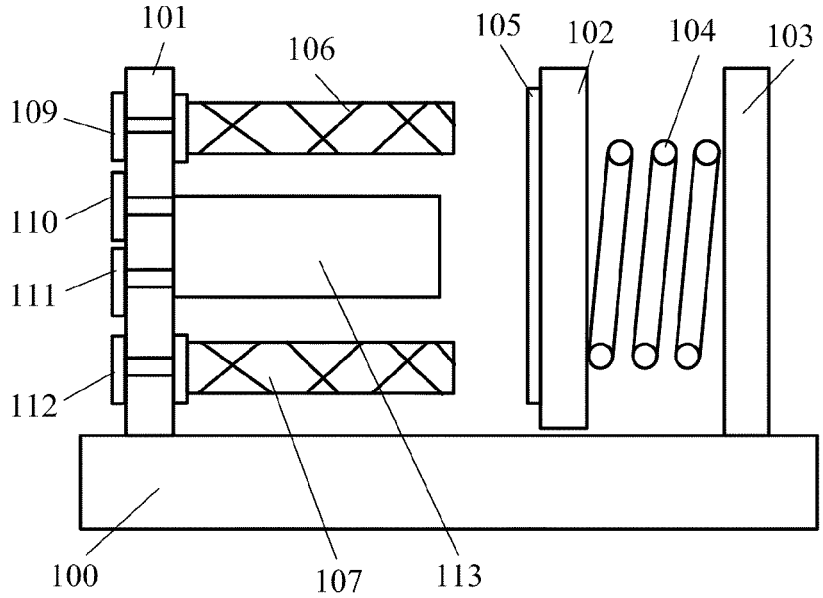
FIG. 9 shows a side view of a single-pole single-throw (SPST) single-coil with return spring embodiment of the invention with a horizontal armature.
Figure 10:
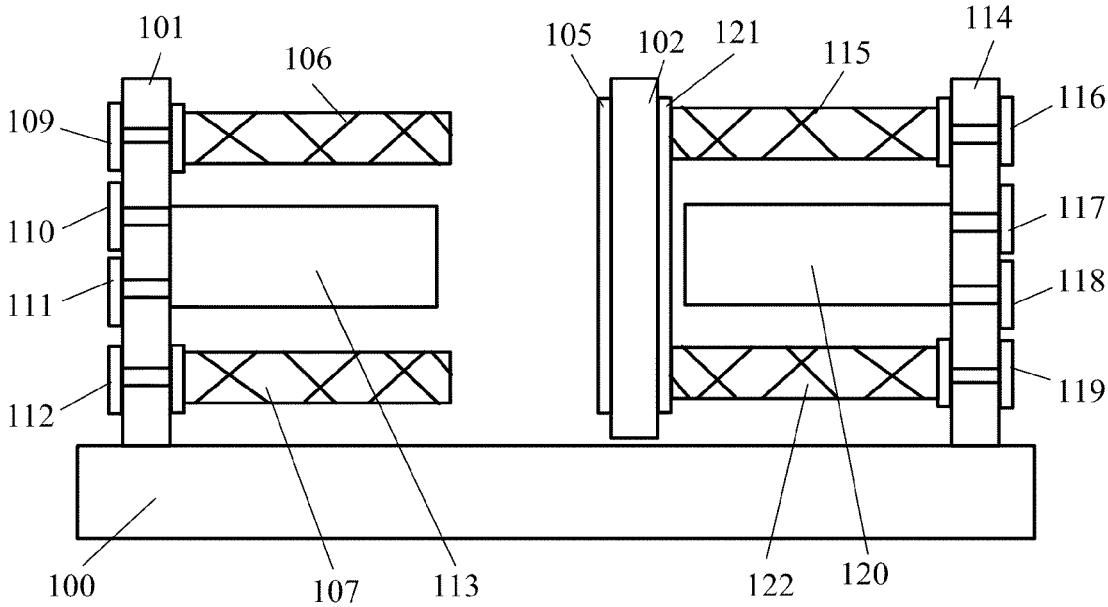
FIG. 10 shows a side view of a double-pole single-throw (DPST) embodiment of the invention using two coils and a horizontal armature.

It will be understood that while the terminology "upper substrate" and "lower substrate" is used in this discussion to distinguish the substrates, no direction or vertical placement is to be inferred by this terminology, which is adopted merely for ease of explanation with reference to the drawings which are conventionally laid out with the fixed ("lower") substrate at the bottom and the movable ("upper") substrate at the top in the embodiment of FIGS. 1-6, or with upper and lower fixed substrates at the top and bottom and a moving substrate in between in the embodiment of FIGS. 7-8. FIGS. 9 and 10 are drawn horizontally, so the terms "first" and "second" fixed substrates are used, in place of "upper" or "lower", but again, no particular priority or orientation is implied by the drawing convention or terminology. In actual use the relay may be mounted vertically or horizontally or in any other orientation, and either of the upper or lower substrates may be uppermost or lowermost as fits the application.

Referring to FIGS. 1-6, a single-pole single-throw (SPST) embodiment of the invention is shown. It will be understood by one skilled in the art that this same design could be used for multiple-pole relays simply by including additional sets of contacts and conductors in parallel with the two shown.

The embodiment shown has a lower substrate (1), preferably made of an insulating material such as FR-4 or a suitable ceramic, on which is mounted a solenoid (6), having an electrical coil (7) wound around an open center (8). Braided electrical contact elements (4) and (5) are connected to pads (24) and (25) on the upper surface of the lower substrate (1). This connection may be accomplished by soldering (22) as shown, or using conductive adhesive, or any other method known to the art.

The lower side of the lower substrate (1) has contact pads (2) and (3), which are connected to pads (24) and (25) by plated-through-holes or vias (20) and (19), respectively. Contact pads (2) and (3) are used to connect electrically to the contact elements (4) and (5). Other contact pads (41) and (42) on the lower side of the lower substrate (1) connect to pads (45) and (46) on the upper side of the lower substrate through vias (43) and (44), respectively. Tabs (47) and (48) connect these pads to the coil (7) to supply the current to the solenoid (6) and thus to operate the relay.

The braided contact elements (4) and (5) are preferably designed as described in the present inventor's U.S. Pat. No. 7,040,902, the content of which is incorporated herein by reference. As described in that patent, the electrical contact is formed from a precursor material, such as an etched or stamped metal sheet, or a plurality of interlaced metal wires. The precursor materials may be formed into a tube or other appropriate shape, and annealed to set their structural form. The annealed structure may then be cut into short segments to form a plurality of individual electrical contacts. The precursor materials are often formed by photo-etching a sheet of conductive material into a mesh with openings of predetermined size and shape. The mesh may also be made by stamping with a conventional metal working die. Alternatively, the precursor material may be made by manipulating a plurality of wires so as to interlace the wires into a unitary structure in the form of a mesh.

The desired form factor of the electrical contact can be made by first rolling a portion of the precursor material into a tube and followed by annealing under a constraint to set the form factor permanently. The tubular structure is then cut into short segments to form individual electrical contacts. The preferred structural forms include folded structures of one or more pleats formed from the precursor material. Such a structure can be made by pressing a unitary mesh structure in a die adapted to form pleated or folded structure in the mesh, followed by annealing the pleated or folded mesh while resident in the die to set permanently the structural form. It is then cut to form individual electrical contacts.

In one embodiment, the electrical contact is formed from a plurality of interlaced and annealed wires. The electrical contact is often formed by weaving or braiding a plurality of wires together to form a mesh, annealing the mesh, and cutting the annealed mesh so as to form a plurality of individual electrical contacts that each has an extended elastic range as a result of the annealing process.

Figure 2A:
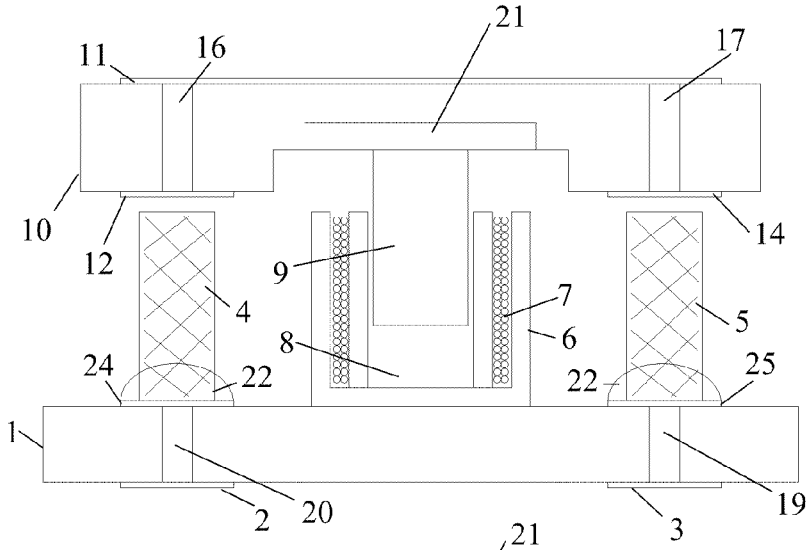
FIGS. 2*a* and 2*b* show a side sectional view of the embodiment of FIG. 1, without a cover, along the lines 2-2 in FIG. 6, with the relay in de-energized and energized states, respectively.

The upper substrate (10) of the relay is mounted to slide upon alignment pins (32) and (33), and is biased away from the lower substrate (1) by bias springs (30) and (31) wound around the pins (32) and (33), respectively. Alternatively, the bias springs (30) and (31) could, if desired, be mounted parallel to, rather than around, the alignment pins (32) and (33), and more or fewer springs could be provided if desired. The lower surface of the upper substrate (10) has contact pads (12) and (14) mounted to align with contact elements (4) and (5), respectively. The bias springs maintain the upper substrate (10) at a position in which there is a gap between pads (12) and (14) and contact elements (4) and (5) when the relay is de-energized, as shown in FIG. 2*a*.

Figure 5:
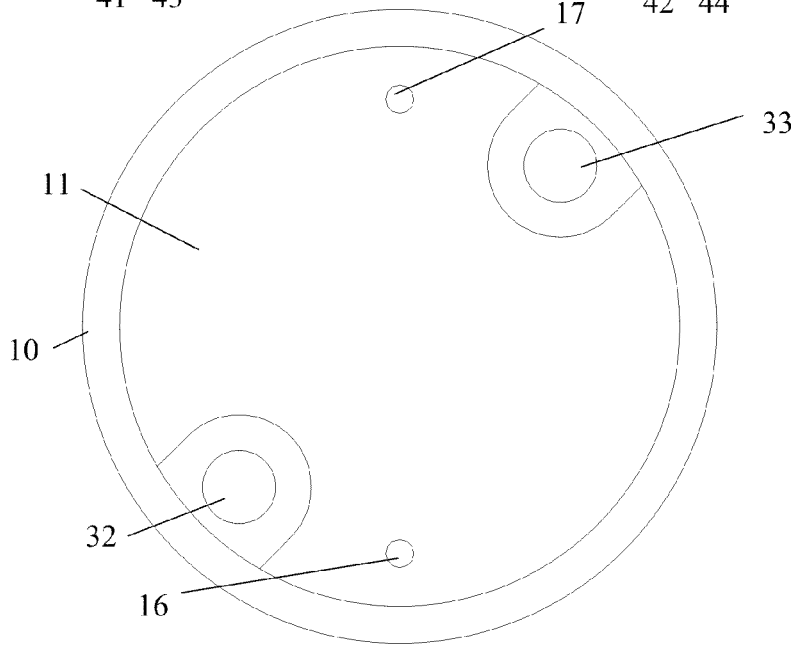
FIG. 5 shows a top view of the upper substrate of the embodiment of FIG. 1
Figure 6:
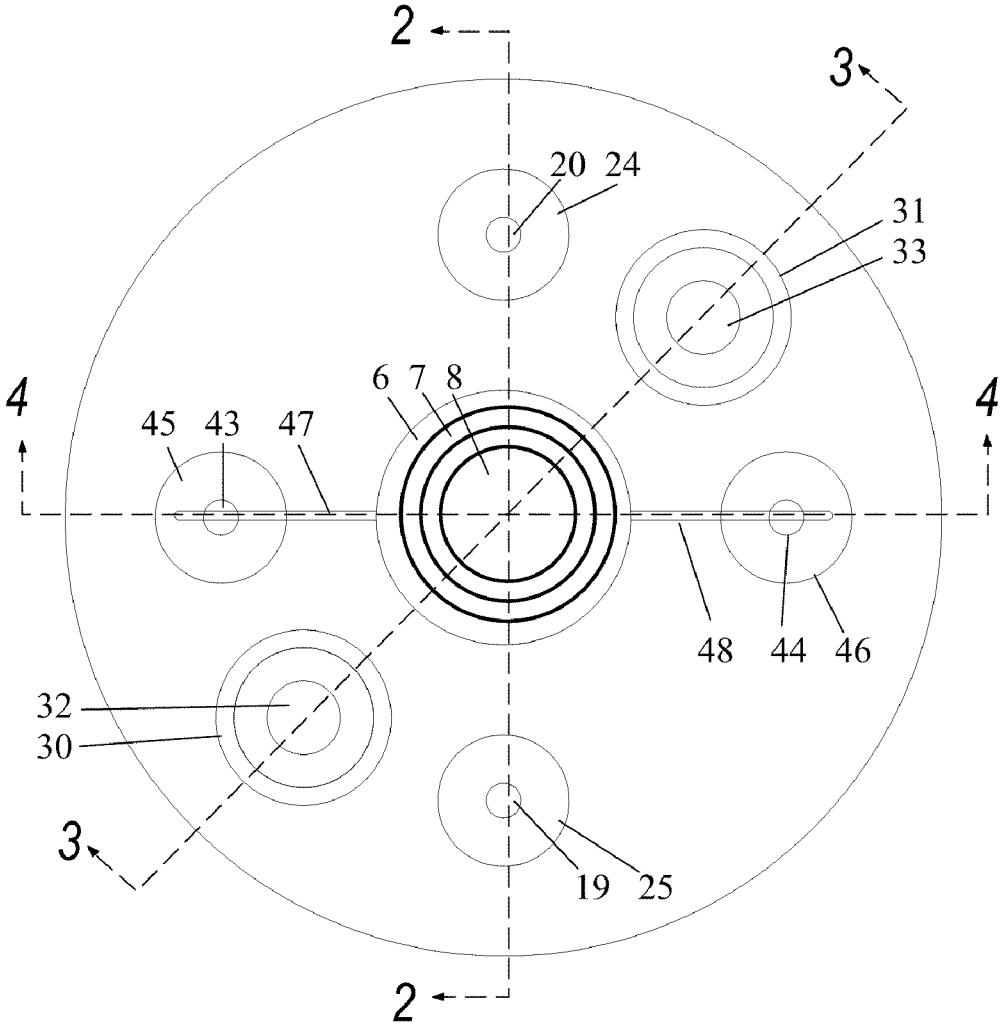
FIG. 6 shows a top view of the lower board of the embodiment of FIG. 1, with cut lines showing the sections of FIGS. 1-4.

In the SPST embodiment shown in FIGS. 1-6, these contact pads (12) and (14) are connected through vias or plated-through holes (16) and (17) to a common conductive path (11) on the upper surface of the upper substrate, so that pads (12) and (14) are electrically connected together. As shown in FIG. 5, the common conductive path (11) can be formed as a copper sheet laminated to essentially all of the upper surface of the upper substrate (10). The upper copper sheet is shaped to allow holes for the alignment pins and holes for plated-through holes or vias (16) and (17). The copper sheet serves also the function of heat redistribution or as an interface to heat sink.

Figure 2B:
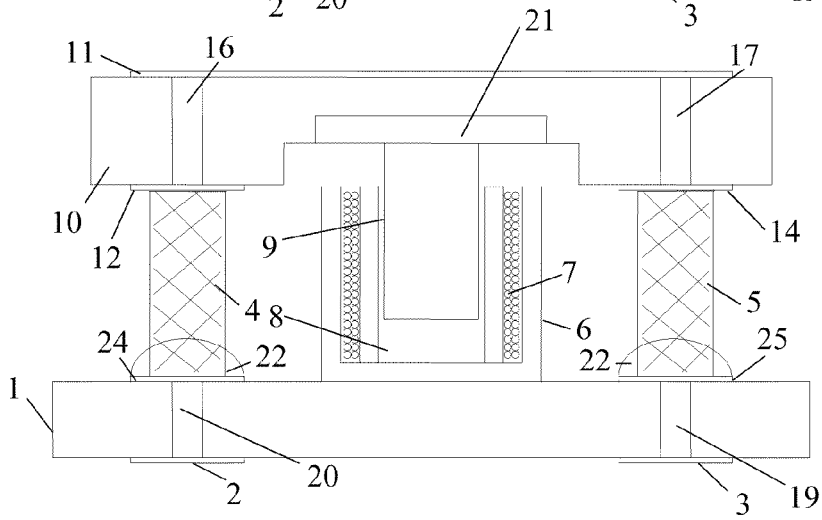
Figure 3:
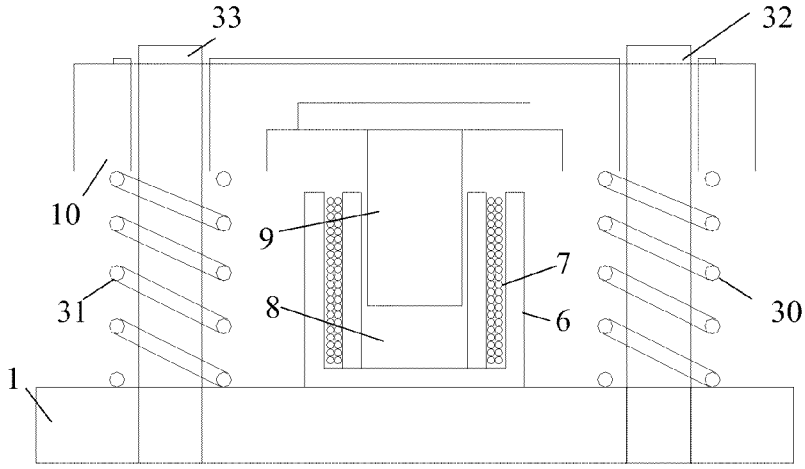
FIG. 3 shows a side sectional view of the embodiment of FIG. 1, showing the return springs and guide posts, along the lines 3-3 in FIG. 6
Figure 4:
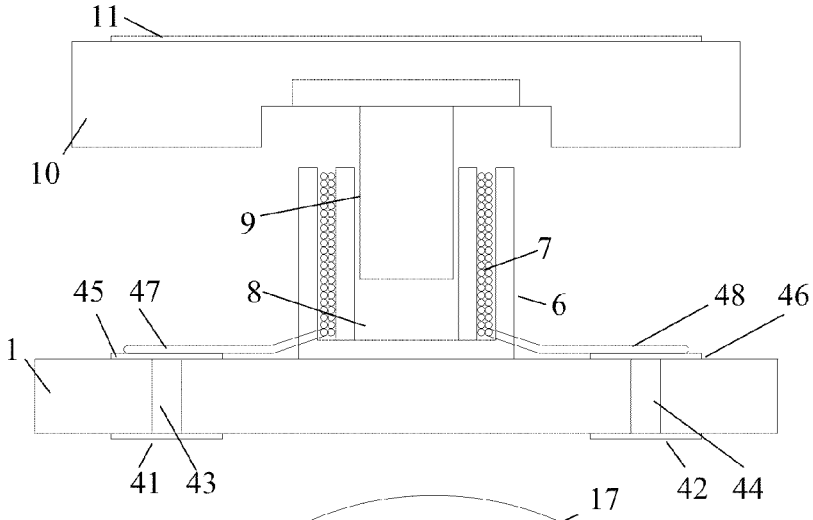
FIG. 4 shows a side sectional view of the embodiment of FIG. 1, along the lines 4-4 in FIG. 6

A plunger (9) is preferably mounted to the lower surface of the upper substrate (10), aligned with the open center (8) of the solenoid (6). As shown in FIG. 2*b*, when current is applied to the coil (7) of the solenoid (6) through pads (41) and (42), a magnetic force is exerted on the plunger (9), drawing it into the center (8), which causes the upper substrate (10) to slide on pins (32) and (33) until pads (12) and (14) make contact with, and begin to compress, contact elements (4) and (5). Current may then flow from pad (2), through via (20), pad (24), and contact element (4) to pad (12), via (16), across path (11) into via (17) to pad (14). Pad (14) contacts contact element (5), and the current proceeds through element (5) to pad (25), via (19) and to pad (3), completing the circuit through the relay.

Normally, continued current through the coil (7) would be used to hold the relay in an energized position with the circuit through the contacts closed. If desired, a permanent magnet element (21) may be mounted to the lower surface of the upper substrate (10), above the plunger (9). By using a permanent magnet element (21), the relay may be designed as a latching relay such that the current to the coil (7) can be turned off once the relay is activated, as the permanent magnet element (21) would attract the solenoid (6) structure and hold the upper substrate (10) in place against the resetting force of the springs (30) and (31). In such a design, a reverse current in the coil (7) would be required to reset the relay by opposing the force of the permanent magnet (21) and forcing the upper substrate (10) away.

For use with a miniature high-current relay of the present invention, as embodied in FIGS. 1-6, an appropriate size for the contact elements (4) and (5) would be a diameter of approximately 14 mil (0.36 mm) and a height of approximately 60 mil (1.5 mm), formed of eight 1.5 mil (0.04 mm) wires wound on an 8 mil (0.2 mm) core. Such a contact would have a current capacity of approximately 3 amps, with a contact resistance of near zero and a total contact force of approximately 10-15 grams at a displacement of 10-15 mil (0.25 mm-0.38 mm). Such a low contact force would permit use of relatively small contact elements (4) and (5), which could have an inductance as low as 0.45 nanohenries at 60 mil (1.5 mm) or 0.3 nanohenries at 40 mil (1 mm). The bulk resistance of the circuit through the relay in such a design has been measured on the order of 10 milliohms, which would mean that at a three amp current, the relay would only dissipate around 90 milliwatts. The small size and efficient design of this embodiment has resulted in a measured insertion loss at 40 gigahertz of as little as 1 dB for each contact element.

Figure 1:
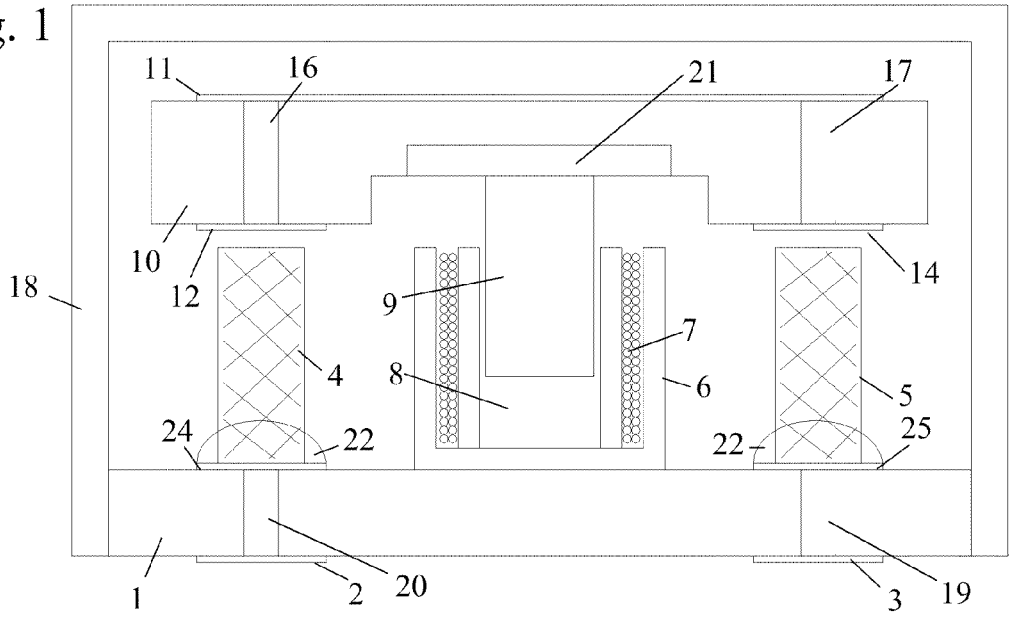
FIG. 1 shows a side sectional view of a single-pole single-throw (SPST) embodiment of the invention with cover, along the lines 2-2 in FIG. 6

The entire unit can be covered as shown in FIG. 1 with an appropriately designed cover (18). The cover may be sealed hermetically if needed, and, if desired, the inside of the cover (18) can be evacuated if a vacuum relay arrangement is desired. The relay can be soldered or separably connected singly or in an array to a circuit board for connections to a control and current source.

In general the size of the relay or switch can be scaled up or down depending on the application. More pairs of braided electrical contact element can be added to increase current carrying capabilities. When there are a number of pairs of braided electrical contact element in a single unit the input braided electrical contact elements can have a taller height than the output braided electrical contact element's so that when the relay or switch is de-activated the taller braided electrical contact elements will return the plunger to its original position and create a gap between the shorter braided electrical contact elements and the corresponding contact pads on the lower side of the top substrate without the need of returning springs.

Finally other appropriate electrical contacts may be used to construct relay or switches based on the same design concept. The braided electrical contact element is a better electrical contact for its many attributes. The present design concept arranges the parts in cylindrical symmetry. Variations in design are possible by arranging the parts differently in the axial direction.

FIGS. 7 and 8 show a second embodiment of the invention, in a double-pole double-throw (DPDT) contact arrangement. In the double-throw (DT) arrangement, a relay can switch a common input to one of two outputs, rather than just making or breaking a circuit as in the single-throw (ST) arrangement shown in the earlier figures. In the discussion below, only one pole set will be discussed, but it can be seen that a second pole is arranged identically on the other side of the relay from that shown in the drawings. It will be understood that single-pole or multiple-pole arrangements are easily adapted from the design shown, by providing fewer or more sets of parallel contact elements and conductors.

Referring to FIGS. 7 and 8, this embodiment of the invention uses fixed upper substrate (72) and lower substrate (78), with a moving middle substrate (75) in between. The middle substrate (75) slides on alignment pins (74), which also serve to fixedly mount the upper substrate (72) to the lower substrate (78). Bias springs (76) bias the middle substrate (75) away from the lower substrate (78), as shown in FIG. 8, which shows the relay in its de-energized position. When actuated by current applied to contacts (79), a solenoid coil (77) attracts plunger (80) on the middle substrate (75), and the relay is in its energized position shown in FIG. 7. Optionally, sleeves (73) may be placed around the pins (74) above and/or below the middle substrate (75) to serve as stops to limit the travel of the middle substrate (75) along the pins (74).

Pads (89) and (91) are provided on the lower surface of the middle substrate (75). Pad (91) is aligned with contact element (90*a*), and is connected through a via or plated-through hole to pad (93) on the upper surface of the middle substrate (75). Pad (89) is an elongated pad, aligned with both contact element (90*b*) and contact element (86*c*), and is connected through a via or plated-through-hole to pad (92) on the upper surface of the middle substrate (75).

The lower surface of the upper substrate (72) has another elongated pad (88), to which is mounted contact element (86*a*), aligned with pad (93), and contact element (86*b*), aligned with pad (92).

The upper surface of the lower substrate (78) has pads (not visible in the figures) on which contact elements (90*a*), (90*b*) and (86*c*) are mounted. These pads are connected through vias or plated-through-holes to normally closed (NC) connection pad (83), common connection pad (82) and normally open (NO) connection pad (81), respectively.

The contact elements in this embodiment are provided in two lengths. Shorter elements (86*a*), (86*b*) and (86*c*) are made with a length which makes contact with the opposed pad (93), (92) and (89), respectively, when the relay is in one state, and breaks contact the opposed pad when the relay is in the other state. Longer elements (90*a*) and (90*b*) are longer, such that they maintain contact with pads at both ends, regardless of the state of the relay. The flexible nature of the braided contact elements in this invention lends itself well to this application, where the length of the longer contact elements may compress or stretch to allow this arrangement without unduly increasing the operation force of the relay. Such longer elements can be mounted with one end or both ends soldered. In this embodiment, contact lengths of 40 mil (1 mm) for the shorter elements (86*a-c*) and 45 mil (1.14 mm) with both ends soldered for the longer elements (90*a-b*), have been found to be acceptable.

As can be seen in FIG. 7, when the relay is energized by applying current through connection pads (79) and coil (77), the middle substrate (75) is attracted toward the lower substrate (78) (against stops (73), if provided). Current may then flow from common contact (82) through contact element (90*b*), across pad (89) on the lower side of the middle substrate (75) to contact element (86*c*), then to normally open contact (81). In this mode, the double-throw relay embodiment of FIGS. 7 and 8 operates similarly to the single-throw embodiment of FIGS. 1-6.

When the relay is de-energized by not applying current through the coil (77), as shown in FIG. 8, the middle substrate (75) is moved by bias springs (76) toward the upper substrate (72), resting against stops (73), if provided. Current may then flow from common contact (82) through contact element (90*b*) and via or plated-through hole to pad (92) on the upper surface of the middle substrate (75), then to contact element (86*b*), across pad (88) on the lower surface of the upper substrate (72) to contact element (86*a*). The current then passes to pad (93) on the upper surface of the middle substrate (75), through via or plated through hole to pad (91) on the lower surface of the middle substrate (75), through contact element (90*a*), then to normally open contact (83).

As with the embodiment of FIGS. 1-6, a case (71) may be provided if a hermetically-sealed or vacuum relay is desired, or merely to provide protection for the operating elements of the relay. The inside volume of the case may be evacuated or filled with an inert gas if desired. If the outermost fixed substrates are made of a ceramic material, the relay can be hermetically sealed by soldering or brazing a metal case around the relay in between the substrates.

FIGS. 9 and 10 show a simplified embodiment of the invention, using a "horizontal" arrangement of parts. As noted above, the term "horizontal" is used merely for ease of description relative to the drawing, and is not intended to limit the mounting or use of the invention.

In this embodiment, the guide posts are dispensed with, and the parts of the relay comprise fixed first substrate (101) and second substrate (103) or (114), mounted upon a base substrate (100). A moving substrate (102) reciprocates toward the first or second fixed substrates. The moving substrate (102) may be free to move along the base substrate (100), or constrained by slots or rails or within a cage or cover (not shown) in a conventional manner.

FIG. 9 shows a single-pole single-throw (SPST) embodiment. Braided contact elements (106) and (107) are mounted on the first substrate (101), connected to pads (109) and (112). A single coil (113) is mounted to the first substrate (101), connected to pads (110) and (111).

When current is passed through the coil (113) from the pads (110) and (111), the relay is in the energized state and a magnetic force attracts the moving substrate (102), which otherwise is held back from the coil by a return spring (104)

mounted on the second substrate (103). When the relay is thus energized, contact pad (105) on the surface of the moving substrate (102) facing the first substrate (101) makes contact with contact elements (106) and (107), thus electrically closing the circuit between pads (109) and (112).

When current ceases to flow through the coil (113), de-energizing the relay, the return spring (104) pulls the moving substrate (102) back, and the circuit is opened.

FIG. 10 shows a double-pole single-throw (DPST) version of the embodiment of FIG. 9, in which an additional contact pad (121) is mounted on the side of the moving substrate (102) facing the second substrate (114), and another set of contact elements (115) and (122) are mounted to the second substrate (114), in contact with pads (116) and (119), respectively.

It will be understood that the embodiment of FIG. 9 could be modified with this arrangement shown in FIG. 10 of a second set of contact elements (115) and (122) making contact with contact pad (121) when the return spring (104) pulls the moving substrate (102) back into the de-energized position shown in FIG. 9. This would transform the SPST relay of FIG. 9 into a DPST relay (or, if either of pad (109) or (112) was connected to either of pad (116) or (119), into a SPDT relay).

However, FIG. 10 shows an additional refinement, in which the return spring of FIG. 9 is replaced by a second coil (120), connected to pads (117) and (118). When the coil (113) is energized, pad (105) shorts contact elements (106) and (107), closing a circuit between pads (109) and (112), as before. When current in coil (113) is discontinued, however, the moving substrate (102) does not automatically return to its starting position, because of the lack of a return spring. Instead, current must be initiated in coil (120) to pull the moving substrate (102) away, and cause pad (121) to short contact elements (115) and (122) instead, closing a circuit between pads (116) and (119). Thus, the relay performs as a locking-type DPST relay (or, as described above, as a SPDT relay if one pad on each side is connected to one pad on the other side).

Accordingly, it is to be understood that the embodiments of the invention herein described are merely illustrative of the application of the principles of the invention. Reference herein to details of the illustrated embodiments is not intended to limit the scope of the claims, which will themselves recite those features regarded as essential to the invention.

What is claimed is:

1. A relay comprising:

a) a first fixed substrate having an upper surface and a lower surface;

b) a moving substrate movably mounted opposite to the upper surface of the first fixed substrate, having an upper surface and a lower surface toward the upper surface of the first fixed substrate, with a conductive sheet applied to the upper surface of the moving substrate, and having at least one contact pad on the lower surface of the moving substrate;

c) at least one bias element biasing the moving substrate away from the first fixed substrate;

d) a plurality of braided contact elements mounted on the upper surface of the first fixed substrate, aligned with the at least one contact pad on the lower surface of the moving substrate;

e) a solenoid mounted on the upper surface of the first fixed substrate;

f) at least one guide pin mounted to the first fixed substrate and passing through the moving substrate, such that the moving substrate is guided for linear movement along the at least one guide pin; and g) a sleeve around the at least one guide pin, between the first fixed substrate and the moving substrate, such that movement of the moving substrate is stopped at a selected distance from the first fixed substrate by contact with the sleeve;

such that when the solenoid is energized the moving substrate is drawn toward the first fixed substrate and the plurality of braided contact elements make contact with the at least one contact pad on the lower surface of the moving substrate.

2. The relay of claim 1 in which the bias element is a bias spring coiled around the guide pin.

3. The relay of claim 1, further comprising a plurality of connection pads on the lower surface of the first fixed substrate, electrically coupled to the plurality of braided contact elements.

4. The relay of claim 1, in which the solenoid comprises a coil surrounding an open center, and further comprising a plunger mounted on the lower surface of the moving substrate, aligned with the open center of the coil, such that when the relay is energized the plunger is drawn into the open center of the coil.

5. The relay of claim 1, further comprising a permanent magnet element mounted to the lower surface of the moving substrate.

6. The relay of claim 1, in which the braided contact elements comprise a plurality of woven or braided interlaced and annealed wires forming a tubular structure.

7. The relay of claim 1, in which at least one contact pad on the lower surface of the moving substrate is aligned with a plurality of braided contact elements, such that when the solenoid is energized the braided contact elements aligned with the contact pad are electrically connected.

8. The relay of claim 1, further comprising:

f) a second fixed substrate, mounted opposite the upper surface of the moving substrate, having an upper surface and a lower surface facing the upper surface of the moving substrate;

g) at least one contact pad on the upper surface of the h) a plurality of braided contact elements mounted on the lower surface of the second fixed substrate, aligned with the at least one contact pad on the upper surface of the moving substrate;

such that when the solenoid is de-energized the moving substrate is drawn toward the second fixed substrate by the bias element and the plurality of braided contact elements on the second fixed substrate make contact with the at least one contact pad on the upper surface of the moving substrate.

9. The relay of claim 8, in which:

a first contact pad on the upper surface of the moving substrate is aligned with a first braided contact element on the second fixed substrate and is electrically connected to a second contact pad on the lower surface of the moving substrate which is aligned with a second braided contact on the upper surface of the first fixed substrate;

a second contact pad on the upper surface of the moving substrate is aligned with a third braided contact element on the second fixed substrate and is electrically connected to a third contact pad on the lower surface of the moving substrate;

the third contact pad is aligned with both a fourth braided contact element and a fifth braided contact element on the upper surface of the first fixed substrate;

the first braided contact element and the third braided contact element are electrically connected on the second fixed substrate;

the second braided contact element and the fourth contact element have a length selected such that the second braided contact element maintains contact with the second contact pad and the fourth braided contact element maintains contact with the third contact pad when the solenoid is energized and when the solenoid is de-energized;

the first braided contact element and the third braided contact element have a length selected such that the first braided contact element makes contact with the first contact pad and the third braided contact element makes contact with the second contact pad only when the solenoid is de-energized; and the fifth braided contact element has a length selected such that the fifth braided contact element makes contact with the third contact element only when the solenoid is energized.

10. The relay of claim 8, in which at least one contact pad on the upper surface of the moving substrate is aligned with a plurality of braided contact elements on the second fixed substrate, such that when the solenoid is de-energized the braided contact elements aligned with the contact pad are electrically connected.

11. The relay of claim 8, further comprising a plurality of connection pads on the upper surface of the second fixed substrate, electrically coupled to the plurality of braided contact elements on the lower surface of the second fixed substrate.

12. The relay of claim 8, in which the bias element is a coil mounted to the lower surface of the second fixed substrate.

13. The relay of claim 8, further comprising a case sealed to the first fixed substrate and the second fixed substrate, encasing at least the moving substrate and the contact elements.

14. The relay of claim 13, in which an inside volume of the case is evacuated.

15. The relay of claim 13, in which an inside volume of the case is filled with an inert gas.

16. The relay of claim 13 in which the first fixed substrate and the second fixed substrate are ceramic, the case is metal, and the case is soldered or brazed to the first fixed substrate and the second fixed substrate.

17. The relay of claim 1, further comprising a case sealed to at least the first fixed substrate, encasing at least the moving substrate and the contact elements.

18. The relay of claim 17, in which an inside volume of the case is evacuated.

19. The relay of claim 17, in which an inside volume of the case is filled with an inert gas.

20. The relay of claim 17 in which the first fixed substrate is ceramic, the case is metal, and the case is soldered or brazed to the first fixed substrate.

21. The relay of claim 1, in which at least one contact pad on the lower surface of the moving substrate is electrically connected to the conductive sheet on the upper surface of the moving substrate.

* * * * *